United States Patent [19]

Benedict

[11] 3,964,524

[45] June 22, 1976

[54] LOOM LAY DRIVE LINKAGE

[75] Inventor: Charles E. Benedict, Tallahassee, Fla.

[73] Assignee: Wayne H. Coloney Co., Inc., Tallahassee, Fla.

[22] Filed: Jan. 8, 1975

[21] Appl. No.: 539,546

[52] U.S. Cl. ..... 139/190; 74/40; 74/43

[51] Int. Cl.[2] ..... D03D 49/60

[58] Field of Search ..... 139/190, 191, 188 R, 139/123, 127; 74/40, 43, 469

[56] References Cited

UNITED STATES PATENTS

| | | | |
|---|---|---|---|
| 535,827 | 3/1895 | Gzoon | 74/40 |
| 972,835 | 10/1910 | Eilhauer | 139/190 |
| 2,228,400 | 1/1941 | Otto | 74/43 |
| 2,328,466 | 8/1943 | Krzenciessa et al. | 74/40 |
| 3,378,042 | 4/1968 | Fransen | 139/190 |
| 3,391,714 | 7/1968 | Quintana | 139/123 |
| 3,858,621 | 1/1975 | Dvoracek et al. | 139/190 |

FOREIGN PATENTS OR APPLICATIONS

| | | | |
|---|---|---|---|
| 578,000 | 6/1933 | Germany | 74/40 |
| 339,454 | 8/1959 | Switzerland | 74/43 |
| 2,955 | 1806 | United Kingdom | 139/190 |

OTHER PUBLICATIONS 1,169,749 5-6-1964 German Application (Ketter).

*Primary Examiner*—James Kee Chi
*Attorney, Agent, or Firm*—A. Yates Dowell, Jr.

[57] ABSTRACT

Apparatus for driving the lay of a weaving loom and including one or more four-bar linkages arranged independently, in parallel, or in series with one another in a manner to advance and retract a loom lay during a fractional portion of the rotation of a crank and providing an extended dwell period for the lay during the remaining portion of the rotation of the crank.

4 Claims, 13 Drawing Figures

10
11
12
13
14
15
16
17
18
19
20
21
22
23
24
25
26
27
28
29
30
31
32
33
34
35
36
37
38
39

13
17
18
19
20
21
22
23
24
25
26
27
28
29
30
31
32
33
34

LOOM LAY DRIVE LINKAGE

BACKGROUND OF THE INVENTION

1. Field of the Invention

This invention relates generally to weaving looms of various kinds and relates particularly to mechanisms for operating the lay of a loom to beat up the weft thread in either a shuttle type loom or a shuttleless type loom.

2. Description of the Prior Art

Heretofore weaving looms have been provided with a lay mounted on spaced swords which were adapted to be oscillated by the loom power plant in timed relationship with other elements of the loom. The lay has included a bed for supporting a weft thread carrying device as such device is driven from end to end of the bed by picker sticks, torsion bars, springs, or other mechanisms and such lay also has included a reed or comb which beats up the weft thread that had been placed in the shed of the warp threads by the weft thread carrying device. Due to the mass of the lay and the speed of the picker sticks or other driving mechanism, such lay normally has been in substantially constant motion back and forth while the weft thread carrying device has been driven from end to end thereof. The constant banging, jerking, and slapping movements have created substantial vibration and noise and when a large number of looms have been in operation in a weaving room the noise level has been sufficiently intense to be detrimental to humans working therein.

Some efforts have been made to provide linkages for driving the lay of a loom so that the lay remains in a substantially fixed or dwell position during a portion of the rotation of a drive crank to permit the weft thread to be transferred from one end of the lay to the other by a shuttle, missile, rapier or other weft thread carrying device and such lay is advanced and retracted during another portion of the rotation of the crank. However, it has been difficult to provide a dwell of greater than approximately 180° of rotation of the crank without using a cam. Some examples of prior art linkages are the patents to Baker 1,683,324 and 1,970,832; Breddin et al 2,004,306; Shimwell 2,382,511 and 2,471,354; and Costa Font 3,110,327.

SUMMARY OF THE INVENTION

The present invention is embodied in a loom lay drive linkage having one or more four-bar linkages arranged in a manner such that when the drive crank is rotated the lay dwells in substantially fixed position during most of the rotation of the crank and such lay is advanced to beat up the weft thread and then retracted to the dwell position during a short portion of the rotation of the crank, the dwell period normally being in excess of 200° of rotation of the drive crank.

It is an object of the invention to provide a loom lay drive linkage in which the lay is in a dwell or near dwell position during most of the rotation of the drive crank and is advanced and retracted during the remaining portion of rotation without the use of a cam drive mechanism.

DESCRIPTION OF THE PREFERRED EMBODIMENT

Figure 1:
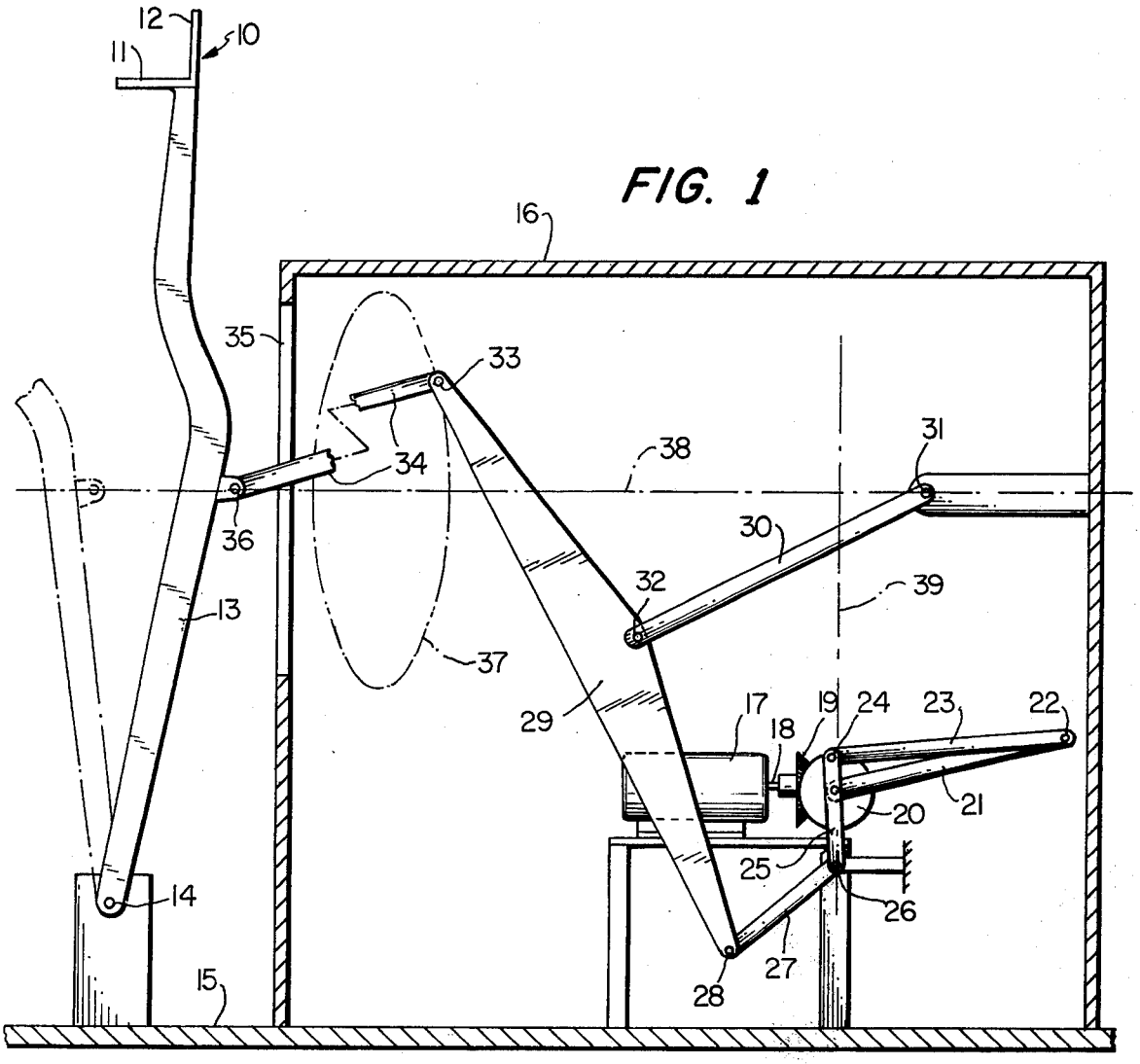
FIG. 1 is a side elevation illustrating one application of the invention having a plurality of four-bar linkages.
Figure 2:
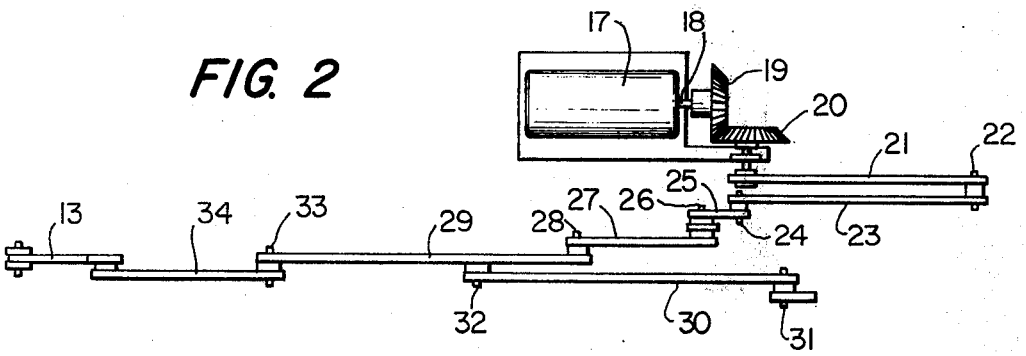
FIG. 2 is a top plan view thereof.
Figure 3:
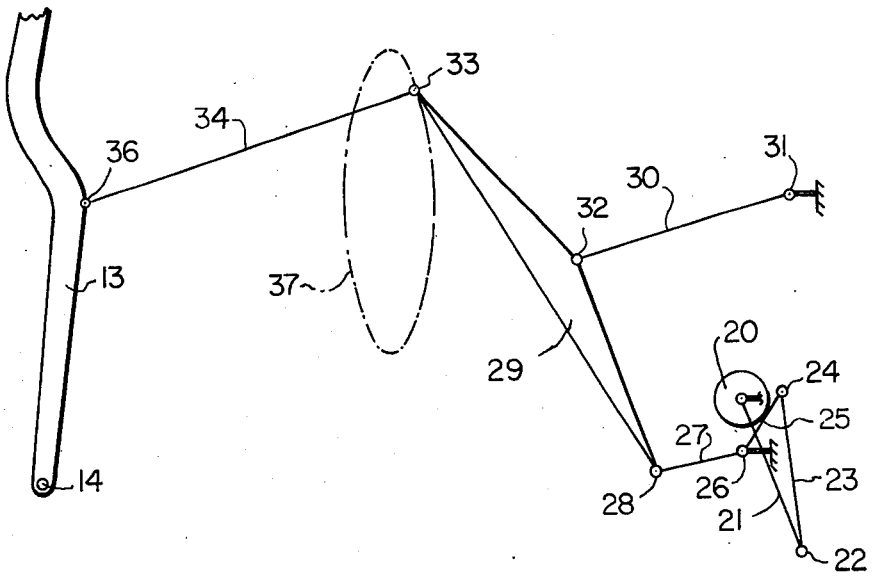
FIGS. 3–6 are schematic side elevations illustrating various positions of the linkages.

With continued reference to the drawings, a loom lay 10 is provided having a generally horizontally disposed bed or raceway 11 and an upstanding reed or comb 12. The lay extends substantially across the width of the loom and is supported adjacent its opposite ends by a pair of spaced generally parallel swords 13 each of which is swingably mounted about a pivot 14 carried by the frame 15 of the loom. Normally a multiplicity of warp threads are carried by the loom and extend in a direction generally at right angles to the lay 10. The warp threads are independently controlled by heddles so that certain of the warp threads are raised while the other warp threads are lowered. A weft thread is adapted to be placed in the shed of the warp threads in any desired manner, as by a shuttle, missile, rapier or the like, after which the swords are advanced so that the reed 12 beats up the weft thread. Thereafter the swords are retracted and the heddles are operated so that some or all of the warp threads are repositioned and another weft thread is placed in the shed of the warp threads and the process is repeated.

It is desirable to provide an extended dwell period for the swords 13 and the lay 10 carried thereby so that the weft thread or filler can be placed in the shed while the lay is immobile. With particular reference to FIGS. 1–11, a housing 16 is provided having a power plant 17 with an output shaft 18 upon which a drive gear or other speed reducer 19 is mounted. Normally the power plant 17 has a speed control (not shown) to permit adjustability of the speed of the drive gear 19. A driven gear 20 is rotatably mounted within the housing 16 and meshes with the drive gear 19.

In the embodiment illustrated in FIGS. 1–7, one end of a drive crank 21 is fixed to the driven gear 20 so that rotation of the driven gear rotates such drive crank. The opposite end of the drive crank is connected by a pivot 22 to one end of a drag link 23 and the opposite end of such drag link is connected by a pivot 24 to one end of a follower 25. The opposite end of the follower is adjustably or fixedly mounted on a shaft 26 which is rotatably supported on a post within the housing in such a manner that the drive crank 21, drag link 23, follower 25 and the housing 16 form a double-crank four-bar linkage.

One end of a driven crank 27 is adjustably or fixedly mounted on the shaft 26 with such driven crank being disposed at any desired angle relative to the follower 25 while the opposite end of such driven crank is connected by a pivot 28 to one end of a triangular shaped coupler 29. A rocker 30 is provided having one end connected by a pivot 31 to the fixed structure of the housing 16 and the opposite end connected by a pivot 32 to an intermediate point on the coupler 29. The free end of the coupler 29 is swingably connected by a pivot 33 to one end of a drive link 34 which extends through a slot 35 in the housing and the opposite end of such drive link is connected by a pivot 36 to at least one of the swords 13. With this arrangement the pivot 33 at the free end of the coupler 29 defines a coupler curve or path of travel indicated by the dot-dash line 37. The driven crank 27, coupler 29, rocker 30 and the housing 16 form a crank-rocker four-bar linkage which is interconnected with and driven by the double-crank four-bar linkage by the shaft 26.

The rocker pivot 31 and the drive link pivot 36 are generally disposed along a common plane indicated by the line 38 which may be substantially parallel with the base frame 15 of the loom or at any desired angle relative thereto. The centers of rotation of the driven gear 20 and the shaft 26 are located along a common plane indicated by the line 39 which is generally normal to the plane 38 and is spaced from the rocker pivot 31.

As a specific example, the rocker pivot 31 is spaced 1.154 inches from the plane 39, the shaft 26 is spaced 5.021 inches below the plane 38, and the center of rotation of the driven gear 20 is located along the plane 39 and is spaced above the shaft 26 a distance of 1.00 inch. The drive crank 21 has a length of 3.26 inches between the center of rotation of the driven gear and the pivot 22, the drag link 23 has a length of 3.26 inches between the pivot 22 and the pivot 24, and the follower 25 has a length of 1.44 inches between the pivot 24 and the shaft 26. The driven crank 27 has a length of 1.46 inches between the shaft 26 and the pivot 28 where it is connected to the coupler 29 and such coupler has a length of 9.198 inches between the pivot 28 and the pivot 33, while the distance between the pivot 28 and the pivot 32, as well as the distance between the pivot 33 and the pivot 32 of the coupler, is equal to 4.72 inches. The length of the drive link 34 between the pivot 33 and the pivot 36 is computed by plotting the generally elliptically shaped path of the coupler curve 37 and the length of the drive link corresponds approximately to the radius of one side of the curve taken along the transverse axis and is approximately 7.4 inches long. These dimensions are merely illustrative and any other dimensions in approximately the same proportions are acceptable.

Figure 4:
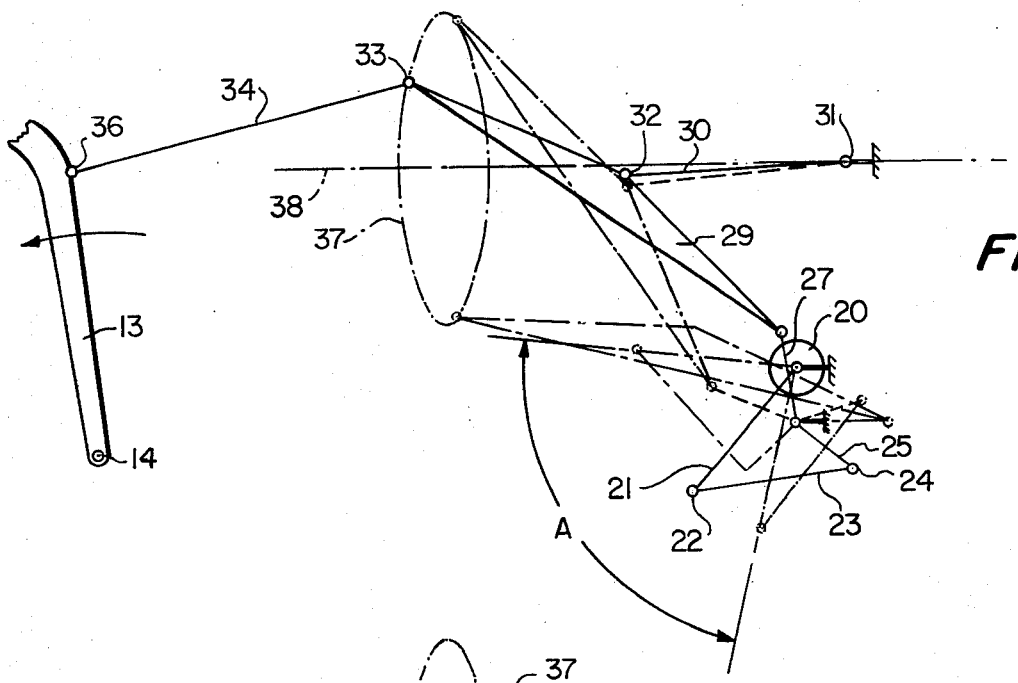
Figure 5:
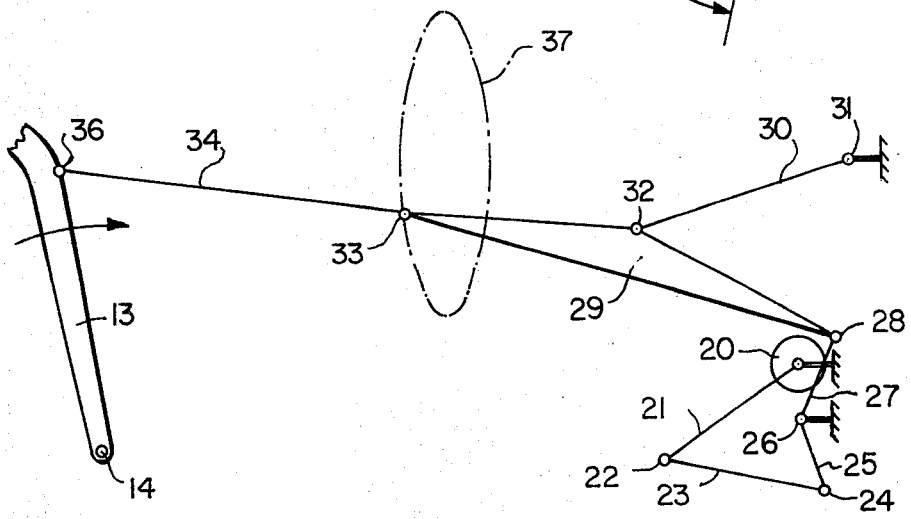
Figure 6:
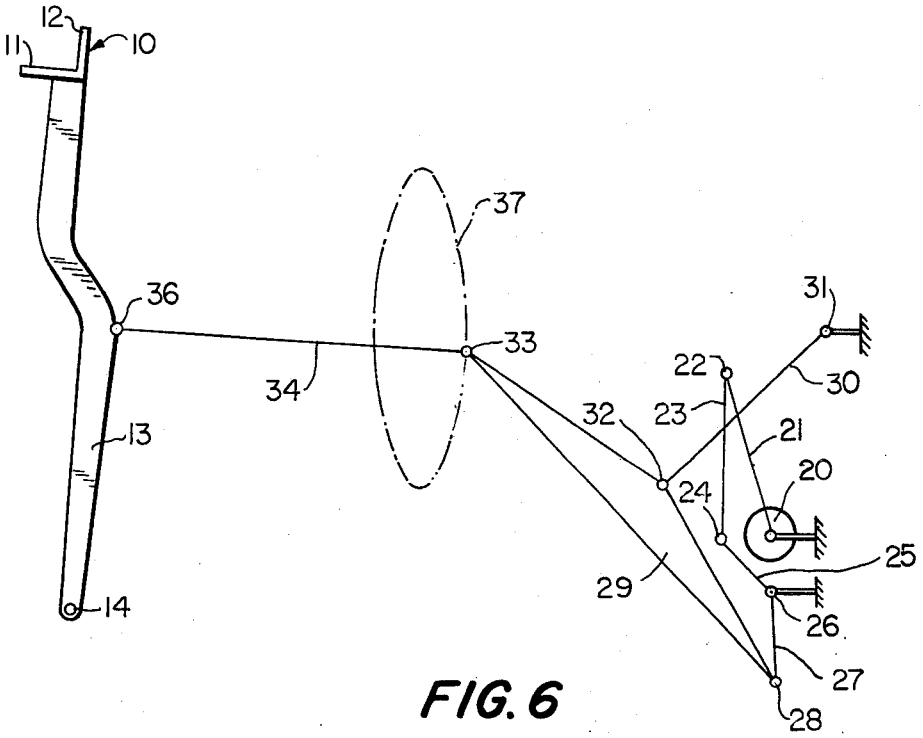

With reference to FIGS. 1 and 3–6, the drive crank 21 is continuously rotated at a constant speed and the linkages cooperate uith each other in such a manner that for approximately 283° of rotation of the crank, the pivot 33 describes the righthand side of the coupler curve and since the drive link 34 is substantially equal to the radius of such curve, substantially no movement of the swords 13 occurs. As illustrated best in FIG. 4, the angle A represents the remaining 77° of rotation of the drive crank 21 during which the pivot 33 of the coupler 29 moves from the dotted line position at the top of the coupler curve to the dot-dash line position indicated at the bottom of the coupler curve. When moving from the dotted line position, forward movement of the drive link 34 is accomplished during approximately 38.5° of rotation of the crank 21 which causes the swords 13 to be swung from right to left, as illustrated in FIG. 4, until the pivot 33 passes the plane 38 at which time the reed 12 of the lay is in its forward-most position and has beat up the weft thread. Continued downward movement of the pivot 33 causes the drive link 34 to retract the swords, as illustrated in FIG. 5. During the last 38.5° of rotation of the drive crank 21, the pivot 33 moves until the coupler 29 is in the position illustrated in phantom or dot-dash lines of FIG. 4 at which time the lay swords are in fully retracted position.

In this embodiment the lay 10 is moved approximately 6 inches to beat up the weft thread. However, since the movement of the lay is a function of the distance between the lay 10 and the pivot 14 of the swords, as well as the location of the pivot 36 of the drive link along the sword 13, the throw or movement of the lay can be altered by moving the connecting point of the pivot 36 along the length of the swords. Normally the swords of a fly shuttle loom are relatively heavy and have a length between 36 and 42 inches and therefore may present a substantial problem in overcoming inertia forces. It is contemplated that these forces may be reduced by locating the pivot 14 substantially above the base of the loom and reducing the overall length of the lay swords as well as substantially reducing the weight of such swords.

Figure 7:
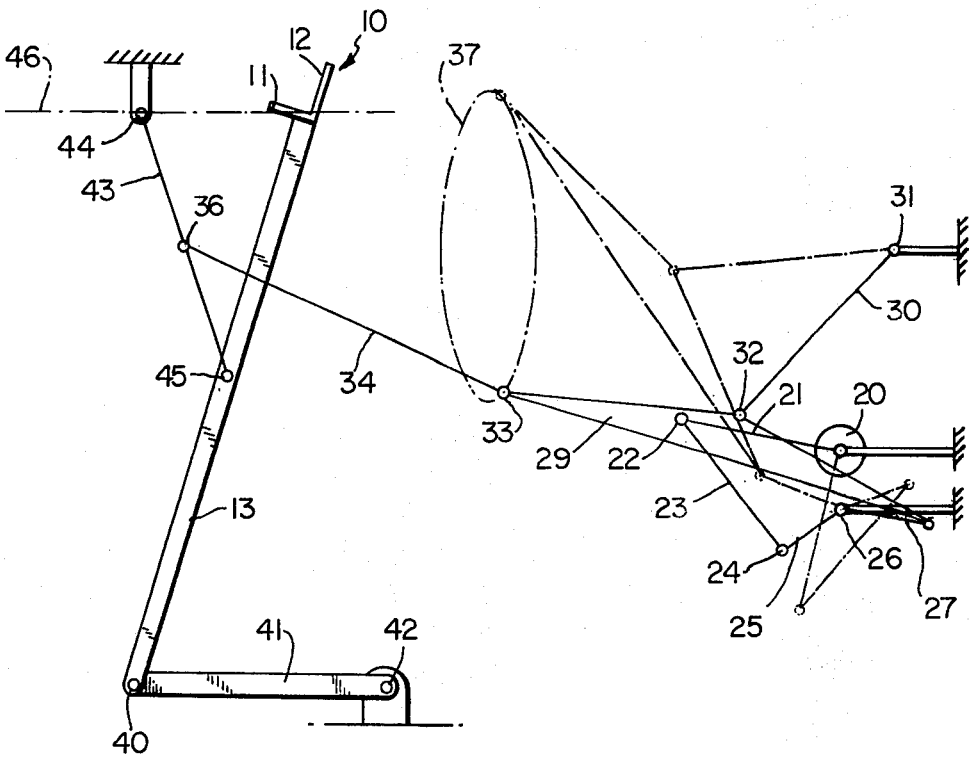
FIG. 7 is a schematic side elevation of the invention in use with a modified form of lay mounting means.

With particular reference to FIG. 7, the drive linkages remain the same as previously described and the lower end of the lay sword 13 is connected by a pivot 40 to one end of a rocker 41 the opposite end of which is swingably connected by a pivot 42 to the frame 15 of the loom. The drive link 34 is connected at one end by the pivot 33 to the free end of the coupler 29 and the opposite end of such drive link is connected by the pivot 36 to a rocker 43. One end of the rocker 43 is connected by a pivot 44 to the fixed structure of the loom and the opposite end of such rocker is connected by a pivot 45 to the sword 13.

In this structure, the rocker 41, sword 13, rocker 43, and the frame define a double-rocker four-bar linkage which is connected to the crank-rocker four-bar linkage by the drive link 34. The double-rocker four-bar linkage constitutes a variable multiplier which permits the lay 10 to move in a relatively straight horizontal path 46 instead of through an arc, as previously described and can be adjusted to control the length of movement of such lay.

As illustrated in FIG. 7, the pivot 36 of the drive link 34 is connected to the rocker 43 substantially midway of the length of such rocker. As long as the distance from the lay 10 to the pivot 45 is substantially the same as the length of the rocker 43, and the pivot 45 is located substantially midway of the sword 13, the lay 10 is moved in approximately a four-to-one ratio with the horizontal movement of the pivot 33 at the free end of the coupler. If a shorter throw or movement of the lay is desired, the pivot 36 at the end of the drive link 34 remains in the same relative position with respect to the pivot 44, however, the length of the rocker 43 between the pivot 36 and the pivot 45 is reduced. When a longer throw of the lay is desired, the length of the rocker 43 between the pivot 36 and the pivot 45 is extended so that the lay can be moved any desired distance without altering the first and second four-bar linkages.

Figure 8:
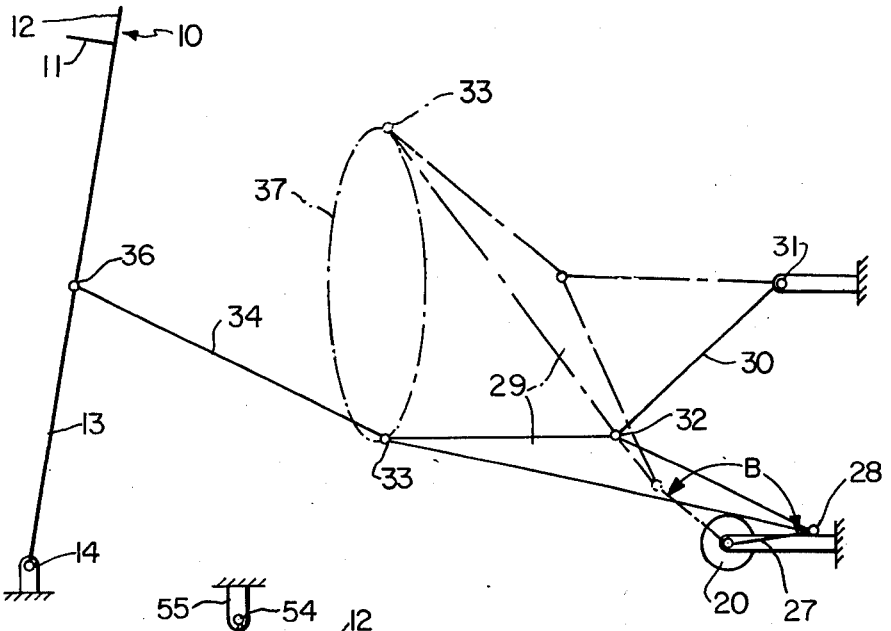
FIG. 8 is a schematic side elevation of another embodiment of the invention using a single four-bar linkage.
Figure 9:
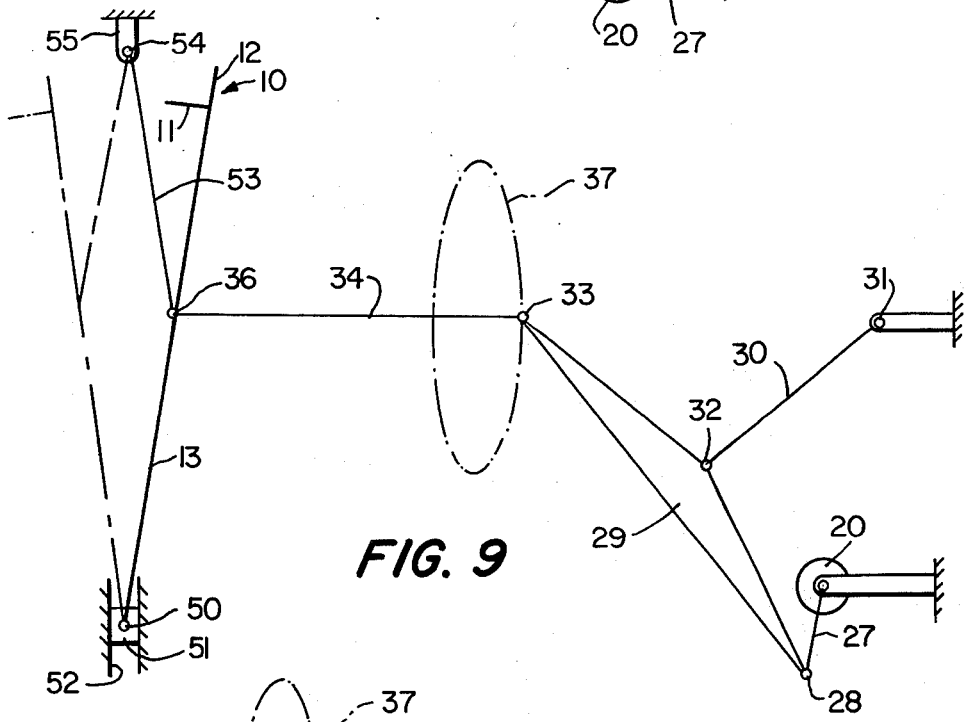
FIGS. 9 & 10 are schematic side elevations having a linkage similar to FIG. 8 and having different lay mounting means.
Figure 10:
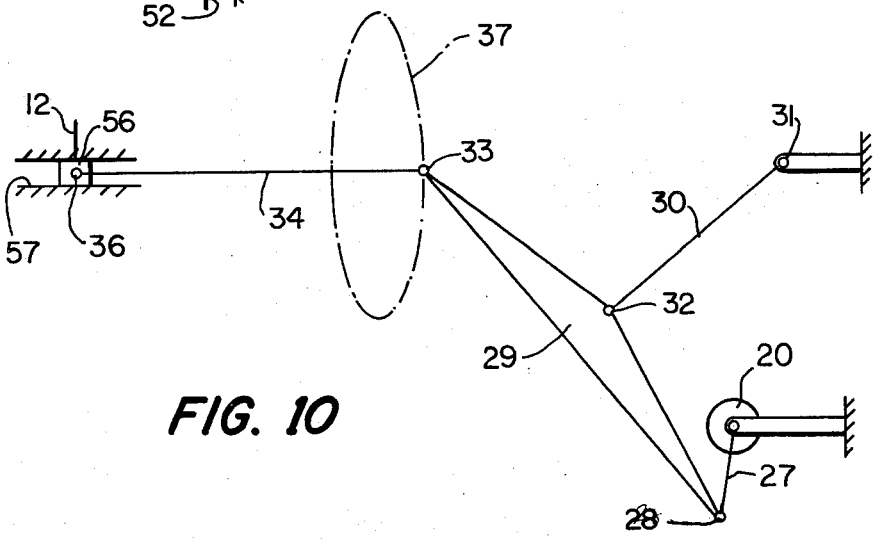

With reference to FIGS. 8–10 another embodiment of the invention is illustrated in which a single four-bar linkage is utilized to provide an extended dwell period for the lay 10 after which the lay is advanced and retracted in a relatively short period. In this embodiment the driven gear 20 is driven by the drive gear 19 or other source of power, as previously described in connection with FIGS. 1–7 but instead of driving the drive crank 21, the driven gear 20 is connected directly to the crank 27 so that such crank causes oscillation of the coupler 29. The driven crank 27, coupler 29 and the rocker 30 are illustrated in one position in full lines and in a second position in phantom or dot-dash lines. The full line position shows the position of the coupler 29 immediately after the lay 10 has been retracted to the dwell position and the phantom line position shows the position of the coupler at the end of the dwell period. Movement of the driven crank 27 through approximately 220° of rotation in a clockwise direction from the position shown in full lines causes the pivot 33 at the free end of the coupler to define the righthand side of the coupler curve 37 until the coupler 29 reaches the position illustrated in dot-dash lines. Substantially no movement of the lay occurs during this time. In the remaining 140° of rotation, indicated by the angle B, the pivot 33 at the free end of the coupler defines the lefthand side of the coupler curve 37.

With particular reference to FIG. 8, when the free end of the coupler 29 follows the lefthand side of the coupler curve, such free end causes the drive link 34 to swing the swords 13 about the pivot 14 to advance and retract the lay 10 and beat up the weft thread which has been placed in the shed of the warp threads by the passage of the shuttle or other weft thread carrying device.

With particular reference to FIG. 9, the drive linkage is substantially the same as the linkage of FIG. 8 but the lower ends of the swords 13 are connected by a pivot 50 to a slider 51 which is slidably mounted within a track 52 mounted on the frame 15 of the loom. The drive link 34 is connected by the pivot 36 to an intermediate point along the swords 13. A rocker 53 has one end swingably connected to the sword 13 by the pivot 36 and the opposite end of such rocker 53 is connected by a pivot 54 to a lug 55 fixed to the frame of the loom. When the drive link 34 moves the swords to the left, such swords can swing about the pivot 50; however, the slider 51 moves along the track 52. Sliding movement of the slider is counteracted by the arcuate movement of the swords so that the lay 10 moves in substantially a straight line.

As illustrated in FIG. 10, the drive linkage is substantially the same as that described in connection with FIG. 8; however, in this embodiment the swords 13 are omitted and the lay 10 is mounted on a slider 56 carried by a track 57 mounted on the frame of the loom. In this modification the drive link 34 is connected by the pivot 36 directly to the slider 56 and causes the slider to move along the track. However, the amount of movement of the lay is in direct proportion to the length of the minor axis of the coupler curve which is the distance moved by the pivot 33 at the free end of the coupler 29 in one plane.

Figure 11:
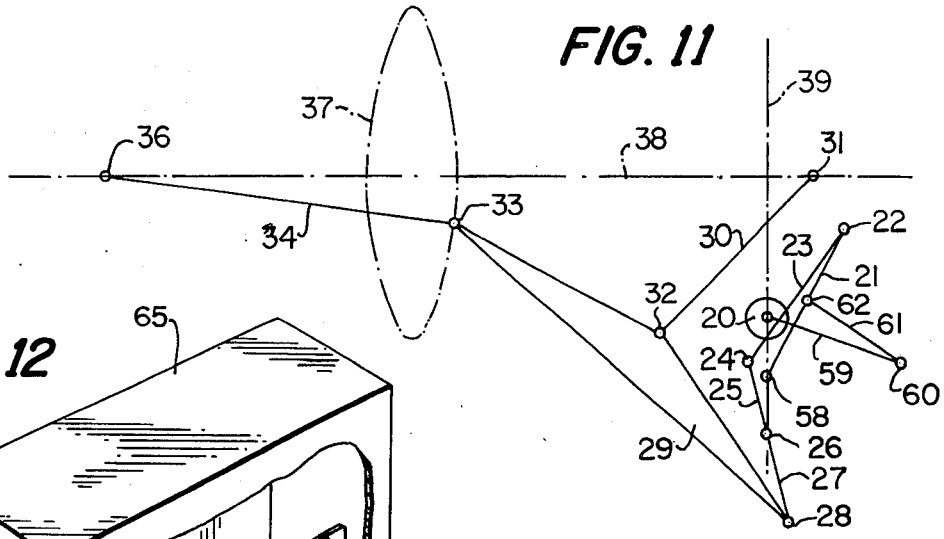
FIG. 11 is a schematic side elevation of another embodiment of the invention using a plurality of serially connected four-bar linkages.

With particular reference to FIG. 11, it is sometimes desirable to extend the dwell period so that substantially no movement of the lay occurs while the drive crank is rotating through an angle in excess of 300°. In order to do this, the double crank four-bar linkage and the crank rocker four-bar linkage remain substantially the same as described in connection with FIGS. 1–7; however, the drive crank 21 is removed from the driven gear 20 and the end of such drive crank is connected by a pivot 58 to a fixed structure supported by the housing 16.

In this embodiment, the driven gear 20 is located in a plane 39 in common with the shaft 26 and the pivot 58 and is spaced from such pivot. A drive crank 59 is provided which has one end connected to the driven gear 20 and the opposite end of such drive crank 59 is connected by a pivot 60 to one end of a drag link 61. The opposite end of the drag link is connected by a pivot 62 to a point intermediate the ends of the crank 21 so that the crank 59, drag link 61, crank 21 and the housing 16 define a second double-crank four-bar linkage which is connected in series with and drives the first double-crank four-bar linkage. The addition of the second double crank four-bar linkage extends the dwell period of the lay 10 so that substantially no movement of the lay occurs while the crank 59 is rotating through more than 300° of rotation. It is contemplated that additional double-crank four-bar linkages could be connected in series to the crank 59 to extend the dwell period to any value desired above the basic four-bar dwell period. However, it should be noted that each additional four-bar linkage which is added raises the power requirements of the power plant and may increase the strain on some of the parts.

Figure 12:
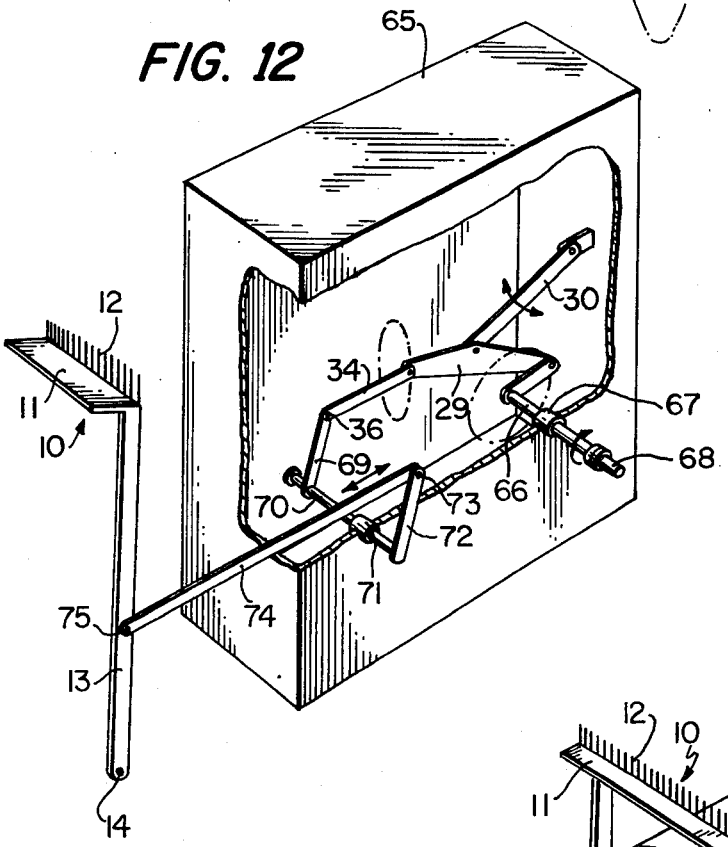
FIGS. 12 & 13 are perspective views with portions broken away and illustrating self-contained units which are connected directly to the lay drive shaft.
Figure 13:
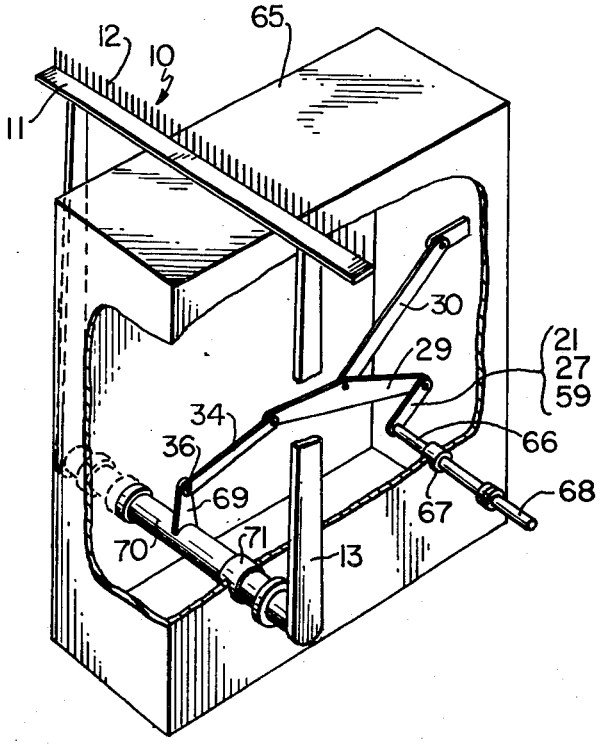

With particular reference to FIGS. 12 and 13, most looms have a drive shaft which is driven by the loom power plant and such drive shaft usually has a cam which drives a cam follower to cause the swords to advance the lay and one or more springs to return the lay to retracted position. Instead of providing an independent power plant 17, as previously described, as well as to replace the cam and springs of conventional looms, a replacement unit is provided which may be mounted on a girt or other portion of the loom frame adjacent to the swords 13. The replacement unit includes a housing 65 having a shaft 66 journaled in bearings 67 and such shaft is adapted to be connected to and driven by the drive shaft 68 of the loom power plant (not shown). Within the housing 65 the shaft 66 is connected to a drive crank 21, 27 or 59 which derives one or more four-bar linkages mounted within the housing. Within the housing 65 the drive link 34 is connected by a pivot 36 to a lever 69 fixed to an output rocker shaft 70. Such output rocker shaft is journalled in bearings 71 and extends outwardly from at least one side of the housing 65.

With particular reference to FIG. 12, the replacement unit is adapted for use with a shuttle type loom having relatively long swords 13 connected by pivots 14 to the frame of the loom. In order to advance and retract the lay, a lever 72 of substantially the same size as the lever 69 is connected at one end to the output rocker shaft 70 and the opposite end of such lever is connected by a pivot 73 to one end of a connecting link or pitman 74. The opposite end of the connecting link 74 is connected by a pivot 75 to the swords 13 so that operation of the loom drive shaft 68 drives the four-bar linkages within the housing 65 to cause oscillation of the rocker shaft 70 which in turn advances and retracts the swords 13 to control the position of the lay.

With particular reference to FIG. 13, the replacement unit is provided for use with a missile or rapier type loom in which the swords 13 are relatively short. In this embodiment the lower ends of the swords are connected directly to the output rocker shaft 70.

In the operation of the lay drive linkage, rotation of the driven crank 27 of the crank rocker four-bar linkage causes the pivot 28 to follow a circular path so that a pushing force is applied to the coupler 29 during a portion of the rotation of such driven crank, and a pulling force is applied to the coupler during another portion of the rotation of such driven crank. The pivot 32 of the rocker 30 oscillates back and forth due to the fixed distance between the pivots 28 and 32 and causes the pivot 33 to pass through a well defined coupler curve 37 which is generally elliptical in shape.

During a majority of the rotation of the crank 27, the pivot 33 at the free end of the coupler 29 describes the righthand side of the coupler curve 37 illustrated in FIG. 1 and since the drive link 34 is approximately the same length as the radius of such portion of the coupler curve, substantially no movement of the swords 13 occurs. When the pivot 33 at the free end of the coupler 29 describes the lefthand side of the coupler curve, the drive link 34 provides a pushing force on the swords 13 and causes the swords to beat up the weft thread. Approximately halfway of the coupler curve the drive link 34 reaches a position substantially parallel with the plane 38 at which time movement of the swords in one direction stops. Continued movement of the free end of the coupler during the second half of the lefthand side of the coupler curve causes the swords to be retracted to their initial positions after which substantially no further movement of the swords occurs until the crank 27 completes more than half of a revolution.

With reference to FIGS. 1–7, a first double-crank four-bar linkage is provided between the drive apparatus and the crank 27 to increase the dwell period of the lay 10. In this embodiment, the pivot 33 at the free end of the coupler 29 describes the righthand side of the coupler curve 37 while the drive crank 21 is rotating through approximately 283° of a revolution and describes the lefthand side of the coupler curve during approximately 77° of rotation.

With particular reference to FIG. 7, the drive link 34 is connected to a variable multiplier so that when the drive link 34 is extended and retracted by the coupler 29, the rocker 43 is oscillated about the pivot 44 so that the pivot 45 follows an arcuate path. The pivot 40 at the lower end of the sword 13 is substantially in alignment with the pivot 44 of the rocker 43 so that initial movement of the rocker 43 causes the pivot 40 to move downwardly and cause the rocker 41 to swing about the pivot 42 as the sword moves from right to left, until the sword passes a plane between the pivots 40 and 44. Continued movement of the drive link 34 causes the pivot 45 and the rocker 41 to move upwardly until the pivot 36 reaches the end of its horizontal movement. Since the distance between the pivots 44 and 45 of the rocker 43 is substantially the same as the distance between the lay 10 and the pivot 45, such lay moves along a substantially horizontal plane 46 to beat up the weft thread.

As illustrated best in FIG. 11, a second double-crank four-bar linkage may be connected in series with the first double-crank four-bar linkage, shown in FIGS. 1–7, to increase the dwell period of the lay still further. In this embodiment, the pivot 33 at the free end of the coupler 29 describes the righthand side of the coupler curve in excess of 300° of rotation of the drive crank 59.

I claim:

1. Apparatus for intermittently advancing and retracting the lay of a weaving loom and providing an extended dwell period after the lay has been retracted, the apparatus comprising a first four-bar linkage mounted on said loom, said first linkage including a drive crank rotatably mounted on said loom, means for rotating said crank at a substantially constant speed, a drag link pivotally connected to said drive crank, a follower swingably connected to said drag link in spaced relationship to said crank pivot, a shaft rotatably supported by said loom, said follower being attached to said shaft in a manner such that rotation of said crank causes rotation of said shaft, a second four-bar linkage including a driven crank fixed to said shaft, a rocker swingably mounted on said loom in spaced relationship to said shaft, an elongated coupler pivotally connected at one end to said driven crank and pivotally connected intermediate its ends to said rocker, the opposite end of said coupler defining an elliptical symmetric coupler curve which has a circular arc on at least one side thereof, drive link means swingably connected at one end to the free end of said coupler and swingably connected at the other end to the lay, said drive link means being of a length corresponding generally to the radius of the circular arc of said coupler curve, and the free end of said coupler defining said circular arc during substantially three-fourths of the rotation of said drive crank and defining the other portion of said coupler curve during substantially one-fourth of the rotation of said drive crank, whereby the lay dwells in a substantially fixed position when the free end of the coupler travels the circular arc portion of said coupler curve and is extended and retracted when the free end of the coupler traverses the other portion of the coupler curve.

2. The structure of claim 1 in which the opposite end of said coupler moves through the circular arc portion of said coupler curve during substantially 280° of rotation of said drive crank.

3. The structure of claim 1 including a third four-bar linkage associated with said drive link means, said third linkage including a first rocker swingably mounted on said loom and pivotally connected to said lay means, a second rocker swingably connected to said lay means and said loom, said drive link means being pivotally connected to said second rocker, said third four-bar linkage being a variable multiplier for the lay means.

4. Apparatus for intermittently advancing and retracting the lay of a weaving loom and providing an extended dwell period after the lay has been retracted, the apparatus comprising a first four-bar linkage mounted on said loom, said first linkage including a drive crank rotatably mounted on said loom, means for rotating said drive crank at a substantially constant speed, a first drag link pivotally connected to said drive crank, a first driven crank rotatably mounted on said loom and pivotally connected intermediate its ends to said first drag link, a second four-bar linkage including said first driven crank, a second drag link pivotally connected to said first driven crank, and a follower swingably connected to said second drag link, a shaft rotatably supported by said loom, said follower being attached to said shaft in a manner such that rotation of said drive and driven cranks causes rotation of said shaft, a third four-bar linkage including a second driven crank fixed to said shaft, a rocker swingably mounted on said loom in spaced relationship to said shaft, an elongated coupler pivotally connected at one end to said driven crank and pivotally connected intermediate its ends to said rocker, the opposite end of said coupler defining an elliptical symmetric coupler curve which has a circular arc on at least one side thereof, drive link means swingably connected at one end to the free end of said coupler and swingably connected at the other end to the lay, said drive link means being of a length corresponding generally to the radius of the circular arc of said coupler curve, and the free end of said coupler defining said circular arc during at least 300° of the rotation of said drive crank and defining the other portion of said coupler curve during the remainder of the rotation of said drive crank, whereby the lay dwells in a substantially fixed position when the free end of the coupler travels the circular arc portion of said coupler curve and is extended and retracted when the free end of the coupler traverses the other portion of the coupler curve.

* * * * *